US006312198B1

(12) United States Patent
Van Vliet et al.

(10) Patent No.: US 6,312,198 B1
(45) Date of Patent: Nov. 6, 2001

(54) GEOGRID AND CIVIL ENGINEERING STRUCTURE COMPRISING SUCH A GEOGRID

(75) Inventors: Arie H. F. Van Vliet, Arnhem; Sebastian M. Peters, Zevenaar; Wim Voskamp, Woerden, all of (NL)

(73) Assignee: Akzo Nobel NV, Arnhem (NL)

( * ) Notice: Subject to any disclaimer, the term of this patent is extended or adjusted under 35 U.S.C. 154(b) by 0 days.

(21) Appl. No.: 09/554,261

(22) PCT Filed: Nov. 30, 1998

(86) PCT No.: PCT/EP98/07776

§ 371 Date: May 12, 2000

§ 102(e) Date: May 12, 2000

(87) PCT Pub. No.: WO99/28564

PCT Pub. Date: Jun. 10, 1999

(30) Foreign Application Priority Data

Dec. 1, 1997 (NL) ..... 1007658

(51) Int. Cl.[7] ..... E02D 17/20

(52) U.S. Cl. ..... 405/302.7; 405/302.6; 405/258.1

(58) Field of Search ..... 405/15, 16, 17, 405/32, 302.4, 302.7, 258.1, 302.6; 428/212, 217, 218

(56) References Cited

U.S. PATENT DOCUMENTS

| | | | | |
|---|---|---|---|---|
| 5,063,099 | * | 11/1991 | Tedesco et al. | 428/109 |
| 5,267,816 | * | 12/1993 | Mercer et al. | 405/258 |
| 5,269,631 | * | 12/1993 | Mercer et al. | 405/258 |
| 5,277,520 | * | 1/1994 | Travis | 405/258 |
| 5,965,467 | * | 10/1999 | Stevenson et al. | 405/258 |
| 6,139,955 | * | 10/2000 | Girgis | 428/375 |

FOREIGN PATENT DOCUMENTS

| | | | |
|---|---|---|---|
| 41 38506 A1 | | 9/1992 | (DE) . |
| 0 0374 365 A2 | | 6/1990 | (EP) . |
| 0 711 649 A1 | | 5/1996 | (EP) . |
| 2 266 540 A | | 11/1993 | (GB) . |
| 4-34037 | * | 2/1992 | (JP) . |
| WO 93/16870 | | 9/1993 | (WO) . |
| WO 94/26503 | | 11/1994 | (WO) . |
| WO 97/03057 | | 1/1997 | (WO) . |
| WO 97/11839 | | 4/1997 | (WO) . |

* cited by examiner

*Primary Examiner*—William Neuder
*Assistant Examiner*—Frederick L. Lagman
(74) *Attorney, Agent, or Firm*—Oliff & Berridge, PLC

(57) ABSTRACT

The invention pertains to a geogrid including drawn, polymeric longitudinal straps which run parallel or substantially parallel to each other and polymeric transverse straps bonded to the longitudinal straps, with the crosswise elastic modulus of the transverse straps being less than 15%, preferably less than 8%, of the lengthwise elastic modulus of the longitudinal straps. Such geogrids have improved strength compared to conventional geogrids.

15 Claims, No Drawings

GEOGRID AND CIVIL ENGINEERING STRUCTURE COMPRISING SUCH A GEOGRID

BACKGROUND OF THE INVENTION

1. Field of the Invention

The invention pertains to a geogrid comprising drawn, polymeric longitudinal straps which run parallel or substantially parallel to each other and polymeric transverse straps bonded to the longitudinal straps.

2. Description of the Related Art

Grids as such are known. In GB 2266540 a grid is described which is made of fully stretched polymeric longitudinal and transverse straps bonded together by means of, e.g., partial fusion of the straps.

WO 94/26503 describes a grid of drawn, polymeric straps bonded together by melting the polymer in the area of contact between the longitudinal and the transverse straps. The melting of the polymer is accomplished by heating conductive particles situated directly underneath the surface of the straps in a high-frequency electromagnetic field. In this way it is ensured that only the portion of the polymer used to effect the bond will melt. The remaining polymer is hardly affected at all and so the strength of the drawn straps remains substantially unaffected. The grid according to WO 94/26503 can, in principle, be subjected to heavy loads.

However, in actual practice it was found that in the case of heavy loads, e.g., such as occur in civil engineering structures (i.e., structures to do with, int. al., hydraulic and road engineering), loaded longitudinal straps will break at a significantly lower load and exhibit a significantly wider breaking load distribution than might be expected on the basis of the specifications of these straps and the bonding technique applied.

SUMMARY OF THE INVENTION

The object of the instant invention is to provide a grid such as described in the first paragraph that is especially suited for use in civil engineering structures and that does not suffer the described premature failure. This is achieved by making use of transverse straps of which the crosswise elastic modulus is less than 15%, preferably less than 8%, of the lengthwise elastic modulus of the longitudinal straps. Preferably, the crosswise elastic modulus is also more than 0.1%, preferably more than 1%, of the lengthwise elastic modulus of the longitudinal straps

DETAILED DESCRIPTION OF PREFERRED EMBODIMENTS

In an especially advantageous embodiment it holds that the crosswise elastic modulus of the longitudinal straps is less than 15%, preferably less than 8%, of the lengthwise elastic modulus of the (drawn) transverse straps. It is further preferred that the crosswise elastic modulus of the longitudinal straps is more than 0.1%, preferably more than 1%, of the lengthwise elastic modulus of the (drawn) transverse straps.

It was found that premature failure probably results from an unfavourable interaction between the longitudinal and the transverse straps. An insight into this interaction will be provided with reference to the example below.

Use is made of a geogrid where drawn, polymeric longitudinal and transverse straps (having a width of 12 mm and always 30 mm apart) have been welded together at an angle of about 90 degrees over their entire contact area. Because the straps are drawn, their molecular chains are oriented essentially in the longitudinal direction. As a result of this orientation the straps have poorer mechanical properties (strength, elastic modulus, elongation at break) crosswise than lengthwise.

If a tensile force is exerted on a longitudinal strap, a certain lengthwise elongation will occur in said strap. In places where the longitudinal strap is bonded to a transverse strap, this elongation will result in a crosswise force being exerted on said transverse strap. As was stated, it is precisely in this direction that drawn straps are less strong. Hence when subjected to heavier loads, the transverse strap will split.

This splitting does not in itself constitute a major problem for the geogrid. However, because the transverse strap and the loaded strap are bonded together over the entire contact area, the transverse strap's splitting or cracking will lead to a crack and/or a load peak in the loaded longitudinal strap. This crack in its turn will lead to the premature failure of the loaded longitudinal strap.

Selecting transverse straps with a comparatively low crosswise elastic modulus means that the transverse straps will be deformed along with the longitudinal straps without splitting or cracking on the side where they are welded to the longitudinal strap, and that the unfavourable effect described will not occur.

Preferably, in the geogrids according to the invention use is made of transverse straps (or longitudinal straps) which even when a tensile strain is exerted on one or more of the longitudinal straps (or transverse straps) of at least 90%, or even at least 95%, of the specific strength of the longitudinal straps (or transverse straps) will co-deform without cracking or splitting. In this way optimum use is made of the strength of the straps.

Geogrids generally are made up of a "lattice" of longitudinal and transverse straps bonded together at an angle, preferably of between 80° and 100°. Especially preferred are geogrids where the straps are bonded together through the polymer of the straps themselves, since such grids can be made comparatively easily without recourse to glue or other adhesives. Moreover, because only a fraction of the polymer of the straps is melted, the strength of the straps is affected hardly if at all. Preferably, only 5 to 100 $\mu$m, or even only 5 to 30 $\mu$m, of the polymer is melted.

A highly suitable method for effecting the bonds in the grids according to the invention is the one where the straps are placed one on top of the other, pressed together, and heated using a radiation source emitting electromagnetic radiation, e.g., a laser, with the strap facing the radiation source being transparent to the radiation and the material at the point where the straps are bonded together absorbing said radiation (to a high degree).

It was found that this technique makes it possible to produce a very strong weld rapidly (e.g., in 10–20 milliseconds). The strength of this weld can be as high as the strength of the employed straps. In other words, two straps which are in the same straight line and have been welded together at a point where they overlap (which overlap, e.g., is at least twice the width of the straps) using this technique will have (substantially) the same strength as a single continuous, untreated strap.

Also, the aforesaid absorption of the radiation may be either by the polymer itself or by a pigment added to the polymer.

In a very simple embodiment the strap facing the radiation source is composed entirely of transparent material. In that case there are several alternatives. For instance, the strap facing away from the radiation source may be made of an absorbent material. Alternatively, the straps to be bonded will both be transparent and a (thin) layer, e.g., ink or a film or foil, of an absorbent material is provided between the straps.

It will be obvious that, in principle, any configuration is possible so long as there is a material absorbing the radiation at the point where the bond is to be effected and so long as the radiation is able to reach this material.

Another suitable embodiment is the one where the strap facing the radiation source is made up of more than one component. Use may be made, e.g., of a bicomponent strap (width 12 mm; thickness 0.55 mm) of transparent polyester (0.50 mm thick) and polyester (0.05 mm thick) to which a pigment has been added or of which the optical properties have been changed. This strap can be bonded to itself or to another strap in various ways, so long as the radiation is able to reach an absorbent section via a transparent section.

One advantage of using the multi-component strap is that this strap can function both as an exposed and as an unexposed strap. This means that during production there is no need to provide two or more supply lines for two or more different materials.

The thickness of both the absorbent section of the strap comprising two or more components and an intermediate layer (foil or film) may be very small.

Preferably, this thickness is between 5 and 100 $\mu$m. However, when selecting this thickness the degree to which the material absorbs the radiation will have to be reckoned with. For that reason there is no absolute lower or upper limit.

Preferably, use is made of radiation having a wavelength of 600 to 1600 nm. For this range a large number of often inexpensive and reliable radiation sources are available. Also, there are many pigments on the market which have high absorption in this range, e.g., carbon black.

Lasers are highly suitable for use in the manufacture of the geogrids according to the invention. Unlike in the case of quartz lamps, the radiation emitted by lasers can be focused using simple means. Furthermore, lasers have a narrow band width ("wavelength window"), so that absorption by the transparent polymer can be prevented entirely or substantially entirely. Lamps, on the other hand, have a comparatively wide spectrum, so that the emitted radiation will always comprise wavelengths which are absorbed by the transparent polymer. In many cases this less desirable absorption will amount to about 35% of total radiation energy. It holds for the invention that this absorption preferably does not amount to more than 15%.

To code the geogrids use may be made of transparent straps provided with a dye which absorbs certain portions of visible light and scatters or reflects others, but which is transparant to the electromagnetic radiation by means of which the straps are welded one on top of the other.

The straps preferably are made of a thermoplastic polymer such as polyamides and polyolefins. Polyester, more particularly polyethylene terephthalate and copolymers comprising ethylene terephthalic moieties, is especially suitable. It also holds that the degree of drawing preferably is greater than 2 and less than 7. Highly suitable straps have been disclosed, int. al., in EP 711 649.

In addition to the aforementioned geogrids the invention pertains to civil engineering structures and works, such as dike bodies, beds, slopes, and the like, which have been reinforced with the geogrid described above.

Within the framework of the present invention the term "strap" refers to bodies where one of the dimensions clearly dominates the two other dimensions and of which the thickness preferably is in the range of 0.2 to 2 mm and the width is in the range of 3 to 30 mm, preferably in the range of 5 to 15 mm. The width of the straps preferably is at least five times their thickness. Given the heavy loads occuring in civil engineering structures, it is preferred that the lengthwise specific strength of the straps exceeds 200 MPa, and preferably 300 MPa.

The crosswise elastic modulus is measured (at a temperature of 21° C. and a relative atmospheric humidity of 65%) by compressing the strap in the thickness direction between a smooth steel plate and, positioned parallel to it, a steel plane having a width of 2 mm and a length several times greater than the width of the strap. The plane is situated on the conical side of a symmetrical wedge having an imaginary point with an angle of 300 and is obtained by flattening this point (through milling), such that the plane is perpendicular to the plane of symmetry of the wedge. The strap is clamped in such a way that the longitudinal direction of the wedge corresponds to the transverse direction of the strap. The crosswise elastic modulus, $E_{tr}$ (in GPa), can be calculated as follows:

$$E_{tr} = \frac{d}{w \cdot b} \cdot \frac{S_{test} \cdot S_{tot}}{S_{tot} - S_{test}}$$

wherein w (in m) is the width and d (in m) is the thickness of the transverse strap, and b (in m) is the width of the plane at the bottom of the wedge (in this case 2 mm). $S_{test}$, the stiffness of the measuring device without a clamped strap, and $S_{tot}$, the joint stiffness of the measuring device and the strap, are determined by the average slope of the force-impression curve between 750 and 2250 N. The wedge's speed is 0.1 mm/min and its movement is halted as soon as a force of 3000 N is reached. One advantage of this method is that the elastic modulus in the direction of thickness of the strap is also taken into account in the measured value.

The lengthwise elastic modulus, $E_{lg}$, and the specific strength of the straps are measured in accordance with ISO10319. For the lengthwise elastic modulus use is made of the 1% secant elastic modulus.

Apart from the elastic modulus, the cracking behaviour of the straps provides a useful indication of the suitability of transverse straps for use in the grids according to the invention. Use is made of a steel cylindrical pin having a mass of 700 g, a diameter of 2 mm, and tip angle of 60°. The pin is dropped over three identical straps placed one on top of the other from such a height that the pin's velocity will be 1.5 m/s the moment it strikes the top strap (approximately in the center).

The depth of penetration is controlled by a stop to about twice the thickness of a single strap. Next, the length of the crack in the top strap is measured. The average crack length is determined by carrying out the experiment ten times and averaging the lengths found. It turned out that transverse straps having an average crack length of less than 60 mm and preferably of less than 40 mm are highly suitable for use in the geogrids according to the invention.

It should be noted that in non-prepublished International patent application PCT/EP 97/03057 geogrids are disclosed where the transverse and the longitudinal straps are welded one on top of the other by means of at least two welding zones per bonding point.

The invention will be further illustrated below with reference to an example. It goes without saying that the scope of the invention is by no means restricted to said example.

EXAMPLE

The straps described below are welded one on top of the other with the aid of a solid state laser (OPC-A020-MMM-CS diode laser array) emitting light at a wavelength of 820 nm. The optics in the welding set-up shape the laser beam into a line 6 mm long. The distribution of intensity is homogeneous over the length of the line. Over the width of the line the distribution of intensity follows, approximately, a Lorentz distribution with a full width at half maximum (FWAHM) of 0.3 mm. The total power of the laser light in the line is 15W. During welding the line is moved crosswise at a velocity of 0.023 m/s across the plane to be welded. This results in a continuous weld of 6 mm wide running the length of the scanning movement. If necessary, this process is repeated until the whole contact area has been welded.

The scanning movement occurs parallel to the longitudinal strap. Consequently, when this strap is 12 mm wide, two scanning movements which do not overlap are needed.

Two types of transparent polyester transverse straps, "2cl" (average crack length: circa 80 mm; specific strength 636 MPa) and "5cl" (average crack length: about 30 mm; specific strength 631 MPa), having the properties indicated in the Table, are each individually welded onto a black polyester strap across the whole contact area and at an angle of 90°, using the aforesaid laser. The black strap is composed of PET to which carbon black has been added and has a specific strength of 631 MPa and a elastic modulus (longitudinally) of 13,8 GPa.

In a tensile tester 10 black straps with a "2cl" transverse strap welded onto them and 9 black straps with a "5cl" transverse strap welded onto them, respectively, are loaded to failure. The average decrease in strength of the black longitudinal straps provided with a "2cl" and a "5cl," respectively, is listed in the Table below. '$E_{tr}/E_{lg}$' stands for the ratio of the crosswise elastic modulus of the transverse straps to the lengthwise elastic modulus of the longitudinal straps; "splitting" indicates whether prior to the failure of the black longitudinal strap there was any splitting in the relevant transverse strap.

TABLE

| Table | 2cl (comparative) | 5cl (invention) |
|---|---|---|
| material | drawn PET | drawn PET |
| thickness (in mm) | 0.52 | 0.53 |
| $E_{tr}$ (GPa) | 2.30 | 1.04 |
| $(E_{tr}/E_{lg}) \times 100$ (in %) | 16.7 | 7.5 |
| splitting | yes | No |
| strength decrease (in %) | 14.1 | 1.9 |

This shows that the decrease in strength and the attendant premature failure of longitudinal straps provided with "2cl" occur hardly if at all in the structure according to the invention ("5cl").

We claim:

1. A geogrid comprising drawn, polymeric longitudinal straps that run parallel or substantially parallel and polymeric transverse straps bonded to the longitudinal straps, characterized in that a crosswise elastic elastic modulus of the transverse straps is less than 15% of a lengthwise elastic elastic modulus of the longitudinal straps.

2. The geogrid of claim 1, wherein the crosswise elastic elastic modulus of the transverse straps is less than 8 % of the lengthwise elastic elastic modulus of the longitudinal straps.

3. The geogrid of claim 1, wherein a crosswise elastic elastic modulus of the longitudinal straps is less than 15% of a lengthwise elastic elastic modulus of the transverse straps.

4. The geogrid of claim 1, wherein the crosswise elastic elastic modulus of the longitudinal straps is less than 8% of the lengthwise elastic elastic modulus of the transverse straps.

5. The geogrid of claim 1, wherein when a strain is exerted on one or more longitudinal straps of at least 90% of the specific lengthwise strength of the longitudinal straps, the greater part of the transverse straps bonded to said longitudinal straps will be deformed without cracking or splitting.

6. The geogrid of claim 1, wherein the longitudinal and transverse straps are bonded together at an angle between 80° and 100°.

7. The geogrid of claim 1, wherein the straps are bonded together by melting a portion of the polymer of the longitudinal strap and the transverse strap.

8. The geogrid of claim 7, wherein the straps are bonded together by melting only 5 to 100 $\mu$m of the polymer of the straps.

9. The geogrid of claim 7, wherein the straps are bonded together by melting only 5 to 30 $\mu$m of the polymer of the straps.

10. The geogrid of claim 1, wherein at least the longitudinal straps are made of a polyester.

11. The geogrid of claim 10, wherein the polyester is polyethylene terephthalate.

12. The geogrid of claim 10, wherein the polyester is a copolymer comprising ethylene terephthalic moieties.

13. The geogrid of claim 1, wherein one of the straps comprises a radiation-absorbent material that absorbs bond-forming radiation at a point where bonding is to be effected between the straps.

14. The geogrid of claim 13, wherein the radiation-absorbent material absorbs radiation having a wavelength of between 600 and 1600 nm.

15. A civil engineering structure that has been reinforced with a geogrid according to claim 1.

* * * * *

UNITED STATES PATENT AND TRADEMARK OFFICE

CERTIFICATE OF CORRECTION

PATENT NO. : 6,312,198 B1
DATED : November 6, 2001
INVENTOR(S) : Arie H.F. Van Vliet et al.

It is certified that error appears in the above-identified patent and that said Letters Patent is hereby corrected as shown below:

Column 4,
Line 17, change "300" to -- 30° --.

Signed and Sealed this

Fifth Day of March, 2002

*Attest:*

*Attesting Officer*

JAMES E. ROGAN
*Director of the United States Patent and Trademark Office*